US005958610A

United States Patent [19]

Yonekawa et al.

[11] Patent Number: 5,958,610

[45] Date of Patent: Sep. 28, 1999

[54] EL ELEMENT HAVING A COLOR FILTER FORMED ON AN UPPER ELECTRODE

[75] Inventors: Tomohiro Yonekawa, Anjo; Hironobu Tamura, Nagoya; Yutaka Hattori, Okazaki; Nobuei Ito, Chiryu; Tadashi Hattori, Okazaki, all of Japan

[73] Assignee: Denso Corporation, Kariya-city, Japan

[21] Appl. No.: 08/802,911

[22] Filed: Feb. 20, 1997

[30] Foreign Application Priority Data

Feb. 22, 1996 [JP] Japan ..... 8-035179

[51] Int. Cl.[6] ..... H05B 33/00; B05D 5/06

[52] U.S. Cl. ..... 428/690; 428/332; 428/336; 428/917; 313/507; 313/509; 257/98; 430/7; 430/319; 427/66; 156/275.5

[58] Field of Search ..... 428/332, 336, 428/690, 917; 313/500, 506, 507, 509; 257/88, 89, 90, 91, 98; 430/7, 27, 319, 349, 350; 427/66; 156/275.5

[56] References Cited

U.S. PATENT DOCUMENTS 5,589,732 12/1996 Okibayashi et al. ..... 313/506

FOREIGN PATENT DOCUMENTS 0 546 856 6/1993 European Pat. Off. .

57-189133 11/1982 Japan .
58-111906 7/1983 Japan .
58-116506 7/1983 Japan .
60-6904 1/1985 Japan .
1-315987 12/1989 Japan .
2-208602 8/1990 Japan .
5-21278 5/1993 Japan .
5-142411 6/1993 Japan .
5-198379 8/1993 Japan .
6-95378 4/1994 Japan .
6-186414 7/1994 Japan .
7-94284 4/1995 Japan .
7-140656 6/1995 Japan .
7-261391 10/1995 Japan .
7-272858 10/1995 Japan .
7-325400 12/1995 Japan .
8-96960 4/1996 Japan .
8-122517 5/1996 Japan .

*Primary Examiner*—Marie Yamnitzky
*Attorney, Agent, or Firm*—Pillsbury Madison & Sutro LLP

[57] ABSTRACT

An EL element having a color filter formed on an upper electrode thereof enables a decrease in the pixel loss or line defects. In the EL element, a lower transparent electrode, first insulating layer, luminescent layer and upper transparent electrode are laminated on a glass substrate. Further, a color filter is formed on the upper transparent electrode. As the color filter there is used a posi-resist having an average molecular weight in a range of from 100 to 50000 or a nega-resist having a polymerization reaction percentage in a range of from 5% to 70%.

12 Claims, 7 Drawing Sheets

EL ELEMENT HAVING A COLOR FILTER FORMED ON AN UPPER ELECTRODE

CROSS REFERENCE TO RELATED APPLICATION

This application is based upon and claims the benefit of priority of the prior Japanese Patent Application No. Hei. 8-35179 filed on Feb. 22, 1996, the contents of which are incorporated herein by reference.

BACKGROUND OF THE INVENTION

1. Field of the Invention

The present invention relates to an EL (Electro-Luminescence) element which is used in a for-use-on-vehicle display device, information unit display device or the like and a method of manufacturing the same.

2. Related Art

In a field of EL elements, there have hitherto been proposed various types of EL elements each of which has provided therein a color filter for the purpose of obtaining a desired luminescence color.

In this case, when the color filter is formed on the side of a glass substrate which opposes the EL element, since light leaks from between the glass substrate and the color filter, color due to light from the EL elements which does not pass through the color filter can be directly seen depending on a viewing perspective, with the result that the quality of the display becomes deteriorated.

On this account, in Japanese Patent Application Laid-Open No. 61-57497, there is disclosed an EL element wherein the color filter is formed directly on the upper electrode of the EL element. Also, an EL element that has a construction that is similar thereto is disclosed in Japanese Patent Application Laid-Open No. 1-315987 as well.

In this type of EL element, it sometimes happens that dielectric breakdown is caused due to the application of voltage. The present inventors manufactured an EL element having a color filter formed on the upper electrode thereof and observed dielectric breakdown spots in the EL element. As a result, they have found out that there is an increased probability of an occurrence of non-luminescent spots (pixel losses) each having a visible size (the diameter: 0.1 mm or so). The inventors also found that when in a dot matrix display device the dielectric breakdown spot hole size has become larger than a line width of the dot matrix display device, there occurs the phenomenon of line defects, due to the application of voltage over a long period of time. That is, the inventors have found out that when dielectric breakdown spots occur, long application of voltage brings about a propagation type breakdown mode in which the breakdown spot continues to be enlarged.

SUMMARY OF THE INVENTION

The present invention has been made in view of the above-mentioned problems and has an object to provide an EL element having a color filter formed on the upper electrode thereof, in which pixel loss, line defect and the like are decreased. Another object of this invention is to provide a method of manufacturing the same.

To attain the above objects, there is provided an EL element having formed on the upper transparent electrode a color filter that is made of organic material, the color filter being made to have an average molecular weight of from 100 to 50000. When the average molecular weight becomes 50000 or less, the mechanical, thermal protection effect of the color filter upon the upper electrode becomes weak. As a result, range of disappearance of the upper electrode that occurs when a dielectric breakdown has occurred becomes larger than the dielectric breakdown spot hole size. That is, the upper electrode disappears even at the end of the dielectric breakdown spot. Therefore, since the application of voltage is not performed to the dielectric breakdown spot, the dielectric breakdown spot is not enlarged. If consideration is given of the strength and durability that are needed when the color filter functions as a film, the average molecular weight needs to be 100 or more.

Also, by making the average molecular weight 10000 or less, it is possible to prevent almost entirely the occurrence of line defects or the like.

It is also possible to form on the upper transparent electrode a color filter that is made of photopolymerization type resin and to set the polymerization reaction percentage thereof so as to fall within a range of from 5% to 70%.

As a result of this, also, it is possible to make the dielectric breakdown into a self-restoration type and thereby decrease the occurrence of line defects or the like.

It is to be noted that the color filter may be formed directly on the upper transparent electrode or may be formed thereon through an insulating material.

Also, it is possible to set the average molecular weight of the color filter to fall within a range of from 100 to 50000 through the adjustment that is made during a heating process.

If it is arranged that the heating temperature during this heating process falls within a range of from 20° C. to 180° C., it is possible to set the average molecular weight of the color filter to be 10000 or less.

In a case where there is executed a step of forming an EL panel by bonding the EL element and an opposing substrate to each other, it is preferable to make the thermo-setting temperature for the bond during the formation of the EL panel not higher than the heating temperature during the heating process.

As a result of this, it is possible to suppress the variation in the average molecular weight that occurs due to the thermo-setting temperature during the formation of the EL panel and thereby maintain the average molecular weight without variation during the formation of the color filter.

In the step of forming a color filter that is made of photopolymerization type resin, it is preferable to set the polymerization reaction percentage of the photopolymerization type resin to fall within a range of from 5% to 70% through the execution of relevant baking and exposing sub-steps.

Further, it is preferable to set the heating temperature during regular-baking to be equal to or lower than the heating temperature during the baking that is prior to the exposure. As a result of this, it is possible to prevent the polymerization reaction percentage from being varied due to the heating temperature during the regular-baking.

BRIEF DESCRIPTION OF THE DRAWINGS

These and other objects, features and characteristics of the present invention will be appreciated from a study of the following detailed description, the appended claims, and drawings, all of which form a part of this application. In the drawings:

DETAILED DESCRIPTION OF THE PREFERRED EMBODIMENTS

First, before explaining embodiments of the present invention, an explanation will be given of the technical background in which an EL (Electro-Luminescence) element according to the present invention has been devised.

Through observations and analyses that have been made of the dielectric breakdown spots, the present inventors have presumed that the cause of the breakdown mode being made into a propagation type resides in the existence of the upper electrode at the end of the breakdown spot and that the breakdown mechanism is as follows.

Figure 2:
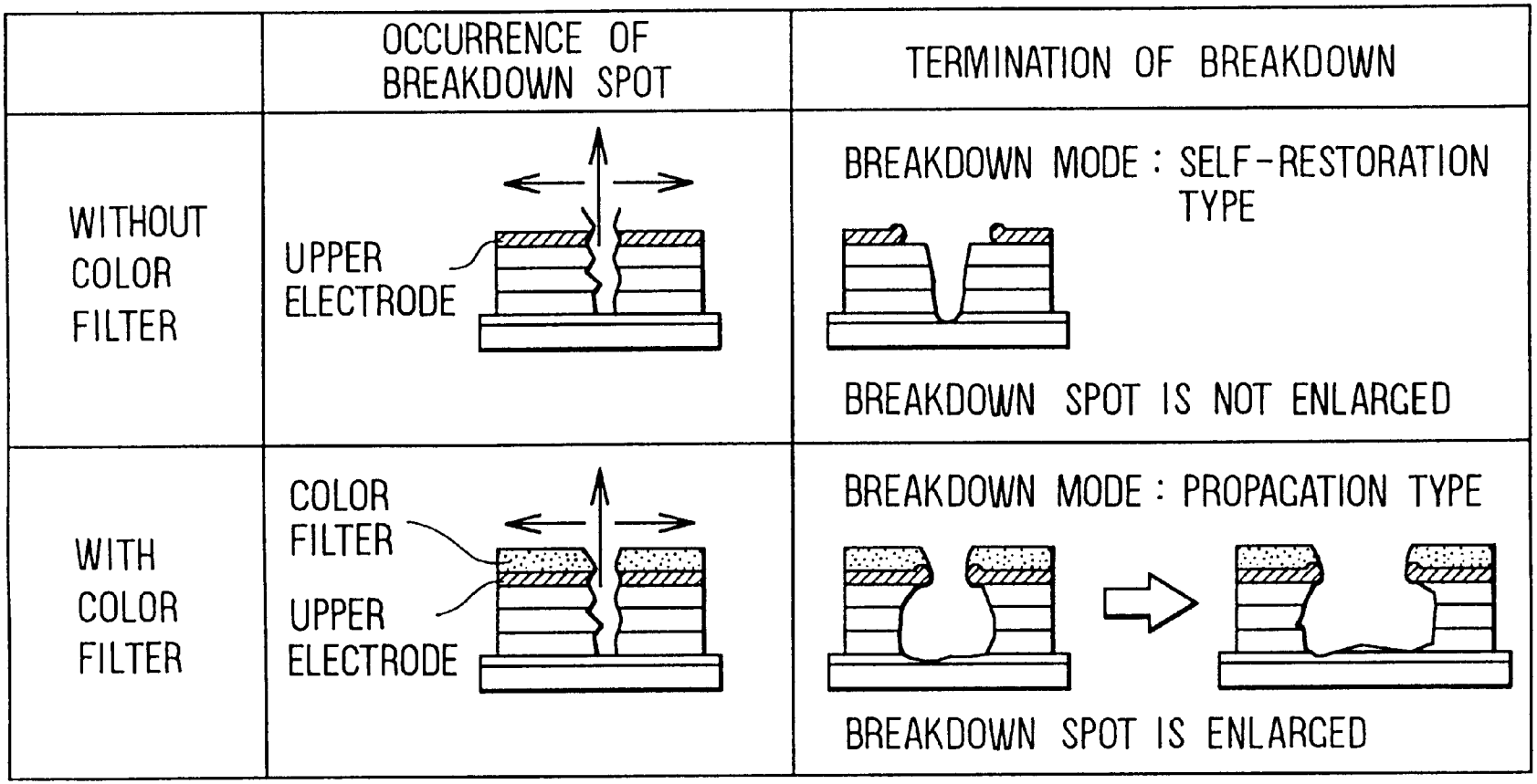
FIG. 2 is a view illustrating a presumed breakdown mechanism.

In a case where no color filter exists on the upper electrode, as illustrated in the upper stage of FIG. 2, when a fine breakdown spot has occurred, the upper electrode splashes upward. Next, the upper electrode dissolves and retreats from the end of the breakdown spot in the outward direction. As a result, the region where the upper electrode ceases to exist becomes larger than the breakdown spot size. In this way, the upper electrode ceases to exist at the end of the breakdown spot, whereby the breakdown mode gets into a self-restoration type.

However, in a case where a color filter is formed on the upper electrode, as illustrated in the lower stage of FIG. 2, when a fine breakdown spot has occurred, the amount of the upper electrode that splashes upward, or the amount of the upper electrode that dissolves and the dissolution thereof spreads in the outward direction, lessens due to the existence of the color filter. For this reason, the region where the upper electrode ceases to exist little spreads from the end of the breakdown spot in the outward direction, i.e., the size of the breakdown spot and the size of this region where the upper electrode ceases to exist become almost equal to each other. As a result, the upper electrode exists on the end of the breakdown spot. Therefore, new dielectric breakdown again occurs from the surrounding periphery of the dielectric breakdown spot. That is, the breakdown mode gets into a propagation type.

For this reason, new dielectric breakdown again occurs from the surrounding periphery of the dielectric breakdown spot, with the result that the pixel losses/defects occur. Further, when the dielectric breakdown spot hole size becomes larger than the line width of the dot matrix display device, the line defects occur and as a result the quality of the display becomes deteriorated.

The reason why the dielectric breakdown mode gets into the above-mentioned propagation type is attributable to the fact that the amount of the upper electrode that splashes upward is lessened by the force of the color filter that presses the upper electrode.

While as the method of manufacturing the color filter there are a pigment dispersion process, dyeing process, printing process, electrodeposition process and the like, in any one of these processes organic material which is a main component thereof is heated at a high temperature and thereby hardened in order to enhance the heat resistance and durability thereof. In this case, the polymerization reaction of the organic material proceeds with the result that the color filter has a large molecular weight and thus exhibits a gigantic network structure.

Also, in general, the resist that is used in the photolithographing step is classified into a posi-resist and nega-resist according to the mode of the photoreaction thereof. In the posi-resist, quinone diazide becomes alkali soluble by radiation of light thereonto and is removed by the use of an alkali developing solution. Therefore, the posi-resist portion that is radiated with no light remains. On the other hand, in the nega-resist, photopolymerization proceeds by radiation of light thereonto and as a result the nega-resist becomes alkali difficultly soluble. Therefore, the nega-resist portion that is radiated with light remains by being treated with an alkali developing solution.

On this account, by adjusting in the posi-resist the average molecular weight thereof and thereby lessening the force of the color filter that presses the upper electrode, the present inventors have their studies of making the dielectric breakdown into a self-restoration type as in the case of no color filter being provided.

Figure 3:
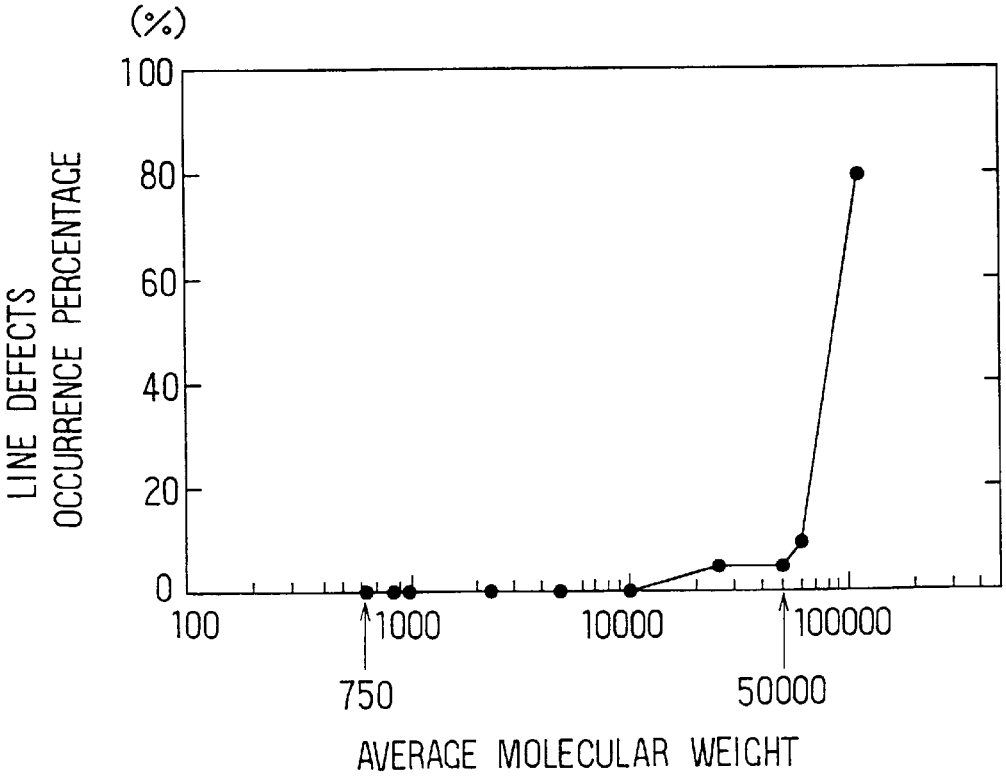
FIG. 3 is a graph illustrating the relation between the average molecular weight of a color filter and the percentage of line defects that occur in an EL element.

FIG. 3 illustrates the experimental results of the average molecular weight and percentage of line defects having occurred. The experimental results have been obtained when the film thickness of the color filter has been set to be 2 $\mu$m. The measurement of the line defects was performed by, when having produced a 64×32 dot matrix EL element and after aging treatment having executed a continuous light emission test, measuring the presence or absence of the line defects therein with the naked eyes. The percentage of the line defects having occurred was determined from the proportion of the specimens that involve the line defects based on all specimens. The aging treatment was performed under the application of a rectangular waveform having voltage: 280 V, frequency: 450 Hz and pulse width: 40 $\mu$sec and the aging treatment duration is 15 minutes. The continuous light emission test was performed by applying a voltage continuously for 100 hours under the same conditions as in the case of the aging treatment. Also, the average molecular weight was measured by GPC (Gel Permeation Chromatography) method.

From this graph, it is understood that by setting the average molecular weight to be 50000 or less, the percentage of the line defects having occurred decreases largely and in a range of 10000 or less almost no line defects occur. This is because when the average molecular weight becomes 50000 or less, the mechanical, thermal protection effect upon the upper electrode weakens. As a result, the region where the upper electrode disappears when the dielectric breakdown has occurred becomes larger than the dielectric breakdown spot hole size, whereby the upper electrode ceases to exist at the end of the dielectric breakdown spot. It is to be noted that if consideration is given to the strength and durability that are needed when the color filter functions as a mechanical film, it is needed to set the average molecular weight to be 100 or more.

Figure 4:
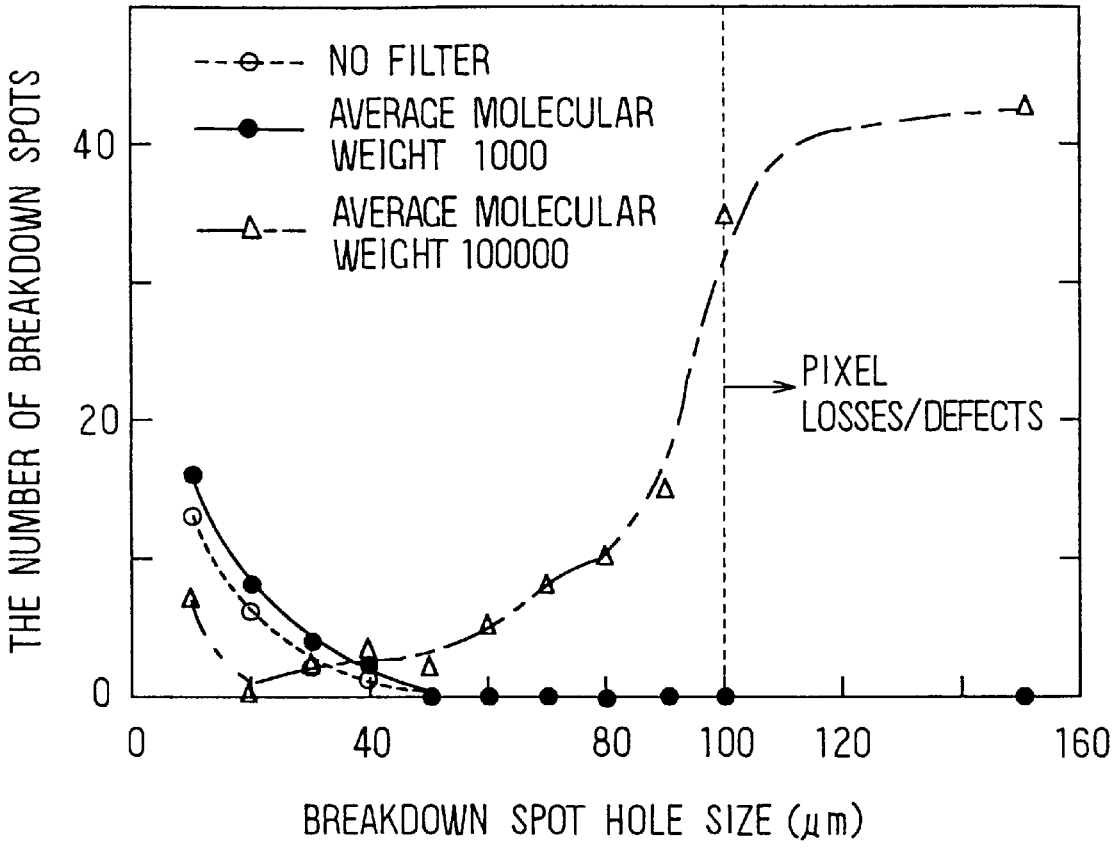
FIG. 4 is a graph illustrating the relation between the average molecular weight of the color filter and the distribution of dielectric breakdown hole sizes.

FIG. 4 illustrates the dielectric breakdown spot hole size distribution as observed relative to the average molecular weight of the color filter. This graphs illustrates the results that have been obtained when no color filter exists, when use has been made of the color filter of which average molecular weight is 1000 and when use has been made of the color filter of which average molecular weight is 100000. When the average molecular weight of the color filter is 100000, the dielectric breakdown spot hole size becomes very large. In particular, when it is 0.1 mm or more, the pixel losses/defects occur and when it is larger than the line width of the dot matrix display, the line defects occur. On the other hand, when the average molecular weight is 1000, the results are almost the same as those which have been obtained when no color filter exists. The dielectric breakdown spot hole size also is small and no line defects occur. This also indicates that the increase in the average molecular weight of the color filter becomes the cause of the dielectric breakdown spot hole size being enlarged and hence the cause of the line defects occurring.

It is to be noted that the measurement of the dielectric breakdown spot hole size distribution was performed by, after aging treatment, bonding the EL element and an opposing glass to each other, injecting a silicon oil into between the two, then conducting a continuous drive test for 1000 hours under the same conditions, then processing the luminescence image at each pixel portion by binarization image processing method, and then determining the number and sizes of the breakdown spots (non-luminescent spots).

While the force with which the color filter presses the upper electrode varies according to the film thickness of the color filter, if the film thickness is small, this force is small. Accordingly, if the film thickness of the color filter is 2 $\mu$m or less and the average molecular weight thereof is in a range of from 100 to 50000, it is possible to make the mode in which the dielectric breakdown occurs into a self-restoration type to thereby prevent the occurrence of the line defects or the like. It is to be noted that if the film thickness of the color filter is 0.1 $\mu$m or less the transmission light cut characteristic is inferior and therefore the resulting color filter cannot be used as the color filter. Therefore, it is needed to set the film thickness to be 0.1 $\mu$m or more.

Also, the present inventors have made their studies of decreasing the force with which the color filter presses the upper electrode by making low in the nega-resist the polymerization reaction percentage thereof, namely by making the color filter soft.

Figure 5:
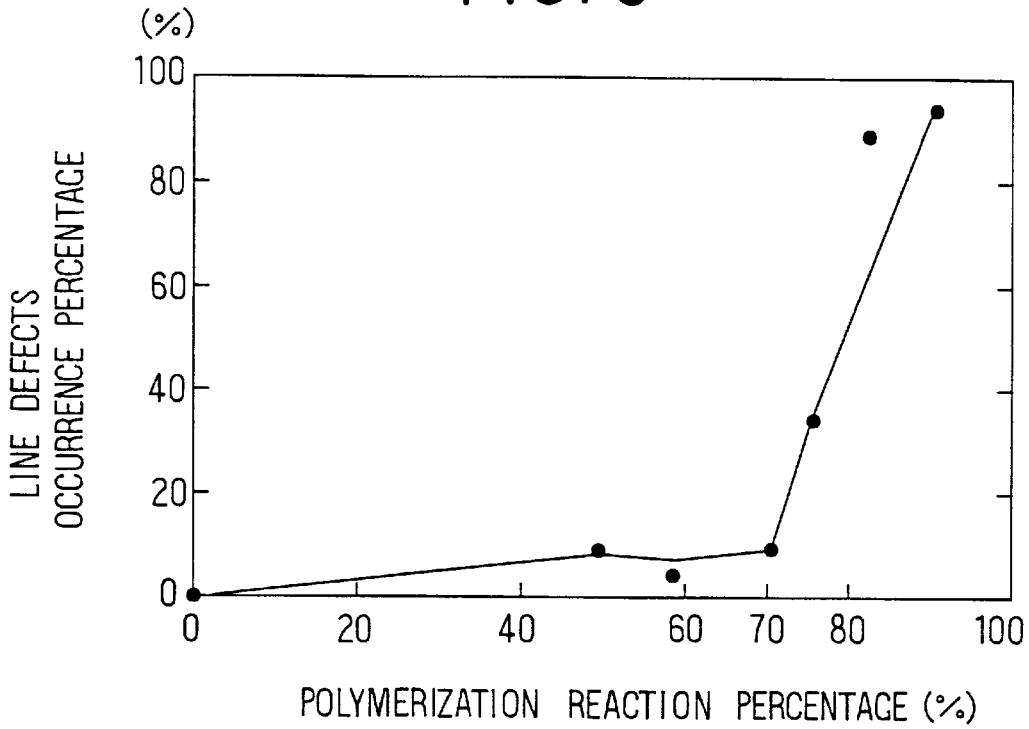
FIG. 5 is a graph illustrating the relation between the polymerization reaction percentage of the color filter and the percentage of line defects that occur in the EL element.

FIG. 5 illustrates the experimental results of the polymerization reaction percentage and line defects occurrence percentage obtained when the film thickness of the color filter was set to 2 $\mu$m. The polymerization reaction percentage was measured by estimating the proportion of unsaturated double bonds ($-CH{=}CH_2$) in the photopolymer as a rate of decrease (cleavage reaction rate of the unsaturated double bonds) in the peak height of the infrared (IR) spectrum with the use of the FT-IR (Fourier Transform Infrared Spectrum) method. In this method, the polymerization reaction percentage was determined from the rate of survival of the unsaturated double bonds in the monomer. Since the extent to which the polymerization or cross-link is made cannot be measured directly, the polymerization reaction percentage was determined indirectly from the rate of the loss of the unsaturated double bonds by measuring the CH out-of-plane vibration of the unsaturated groups from the IR spectrum and. The amount of C=C groups decreased in each treatment step is estimated from the spectrum that has been obtained with the use of the FT-IR method and, using the characteristic absorption intensity ratio, the amount of C=C groups decreased is determined. Here, regarding the end vinyl group ($\delta$ $CH_2$) of 984 $cm^{-1}$, the absorption intensity ratio is determined using as a reference the $CH_3$ deformation vibration of 1367 $cm^{-1}$, whereby the polymerization reaction percentage in each treatment has been estimated.

From this FIG. 5, it is understood that if the polymerization reaction percentage is 70% or less, it is possible to decrease largely the percentage of the line defects that have occurred. It is to be noted that if the color filter is to function as a color filter, the polymerization reaction percentage needs to be set at 5% or more.

(First Embodiment)

Figure 1:
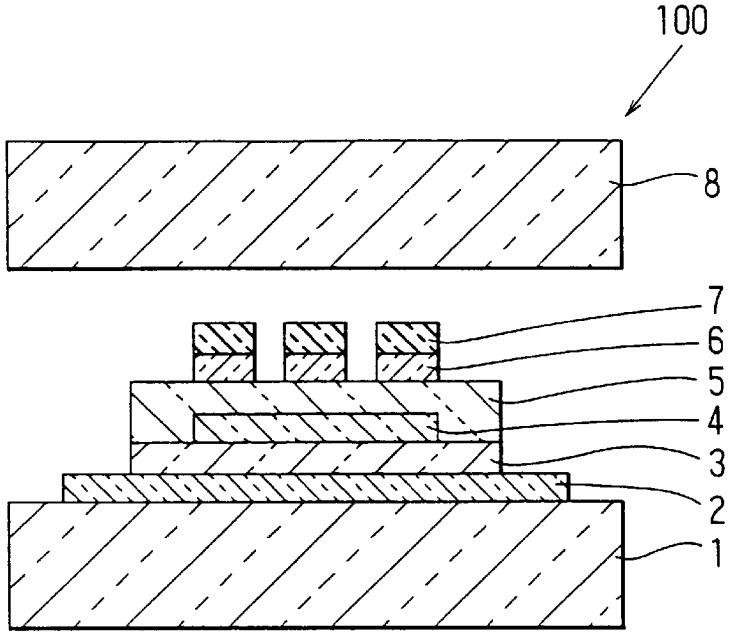
FIG. 1 is a typical view illustrating a longitudinal section of an EL panel according to a first embodiment of the present invention.

FIG. 1 illustrates a typical sectional structure of an EL panel 100 according to a first embodiment of the present invention.

In FIG. 1, a thin film EL element is formed in such a manner that on a glass substrate 1 which is an insulating substrate there are laminated a lower electrode 2 that consists of an optically transparent ITO (Indium Tin Oxide) film, first insulating layer 3 that is composed of ditantalum pentaoxide ($Ta_2O_5$) or the like, luminescent layer 4, second insulating layer 5, transparent electrode 6 that is composed of an ITO film and color filter 7, in this order.

For the luminescent layer 4, in this embodiment, zinc sulfide (ZnS) is used as a host material and manganese is added as a main luminescent material.

The color filter 7 is a red color filter that makes the orange color luminescence of the luminescent layer 4 turn red. An average molecular weight of the color filter 7 has been adjusted to fall within a range of from 100 to 50000.

The above-mentioned EL element is bonded to an opposing glass substrate 8. There is sealed a light transmission insulating material such as silicon oil therebetween.

A method of manufacturing this EL panel 100 according to the first embodiment will now be explained.

First, the lower transparent electrode 2 is formed on the glass substrate 1. As the deposition material there is used that which has been prepared by adding tin oxide ($SnO_2$) to an indium oxide ($In_2O_3$) powder and mixing the two with each other and forming the resulting mixture into pellets. As the film forming device there is used an ion plating device. In more detail, first, with the temperature of the glass substrate 1 being maintained to be at 150 ° C., the interior of the ion plating device is evacuated until the pressure thereof becomes $5\times10^{-3}$ Pa. Thereafter, argon (Ar) gas is introduced thereinto. While the interior thereof is maintained to be at $6.5\times10^{-1}$ Pa, the beam power and high frequency power are adjusted so as for the rate of film formation to fall within a range of from 1.0 to 3.0 Å/sec.

This lower transparent electrode 2 is formed into a predetermined pattern through the execution of a photolithographing process. At this time, as the etching solution, there is used that which has hydrochloric acid (HCL) and ferric chloride ($FeCL_3$) as main components.

Next, on the lower transparent electrode 2 there is formed by sputtering the first insulating layer 3 that is composed of tantalum pentoxide ($Ta_2O_5$). In more detail, the temperature of the glass substrate 1 is maintained to be at 200 ° C., the interior of the sputter device is maintained to be at 1.0 Pa and a gaseous mixture of argon (Ar) and oxygen ($O_2$) is introduced into the device (200 cc/min), whereby sputtering is performed under the conditions wherein the high frequency power is 1 kW and the deposition rate is 2 nm/sec.

On the first insulating layer 3 there is formed by deposition process a zinc sulfide:manganese (ZnS:Mn) luminescent layer 4 wherein zinc sulfide (ZnS) is used as the host material and manganese (Mn) is added thereto as the main luminescent material. In more detail, the temperature of the glass substrate 1 is maintained to be at 120° C. and the interior of the sputter device is maintained to be at $5\times10^{-4}$ Pa or less, whereby electron beam deposition is performed under the condition wherein the deposition rate is in a range of from 1.0 to 3.0 Å/sec.

Next, on the luminescent layer 4 there is formed the second insulating layer 5 that is composed of tantalum pentoxide ($Ta_2O_5$) by the use of the same method as that by which the first insulating layer 3 is formed. Further, there is formed the transparent electrode 6 that is composed of ITO by the use of the same film forming method and etching method as those by which the lower transparent electrode 2 is formed.

Thereafter, on the transparent electrode 6 there is formed the color filter 7 with the use of the coating process. In more detail, first, a solution (Orient Chemical Inc. VALIFAST #3306 solvent MEK 25%) that has been prepared by dissolving a red color pigment (azo system) into a 25% methyl ethyl ketone (MEK) solution is mixed into a posi-resist (SHIPLEY S-1400) whose main component is a mixture of alkali soluble phenol resin and quinon diazide to thereby prepare a red color resist (having 7% of dye mixed therein).

Next, this red color resist is coated by a spinner onto the substrate under the conditions of 500 rpm and 30 sec, thereafter, prebake is performed within an oven at a temperature of 90° C. for 3 minutes. The resulting substrate is further formed into a predetermined pattern by the photolithographing process.

Next, in order to set the range of the average molecular weight to fall within a range of from 100 to 50000, heating and baking are performed within an oven under the heating conditions of 140° C. and 30 minutes. As a result of the measurement that has been performed at this time with the use of the GPC (Gel Permeation Chromatography) method, the average molecular weight was approximately 750.

It is to be noted that the film thickness of each layer is as follows. The lower transparent electrode 2 is 2000 Å, the first and second insulating layers 3 and 5 are 1500 Å, the luminescent layer 4 is 6000 Å, the upper transparent electrode 6 is 2000 Å and the color filter 7 is 2 $\mu$m.

Thereafter, the EL element that has been manufactured in the above-mentioned way is bonded to the opposing glass substrate 8 by the use of bonding agent, and, further, silicon oil is injected into the clearance therebetween to thereby form an EL panel 100. Here, in the step of hardening the bonding agent for bonding the EL element and the opposing glass substrate 8 to each other, the temperature at which the bonding agent is heated was set to be at 140° C. It is to be noted that it is preferable to set the heating temperature during the bonding agent hardening step to be at a temperature that is equal to or lower than the heating temperature for heating the color filter 7. This is because when that heating temperature is set to be at a temperature higher than the heating temperature for heating the color filter 7, the polymerization reaction proceeds with the result that the average molecular weight of the color filter 7 varies inconveniently.

Figure 6:
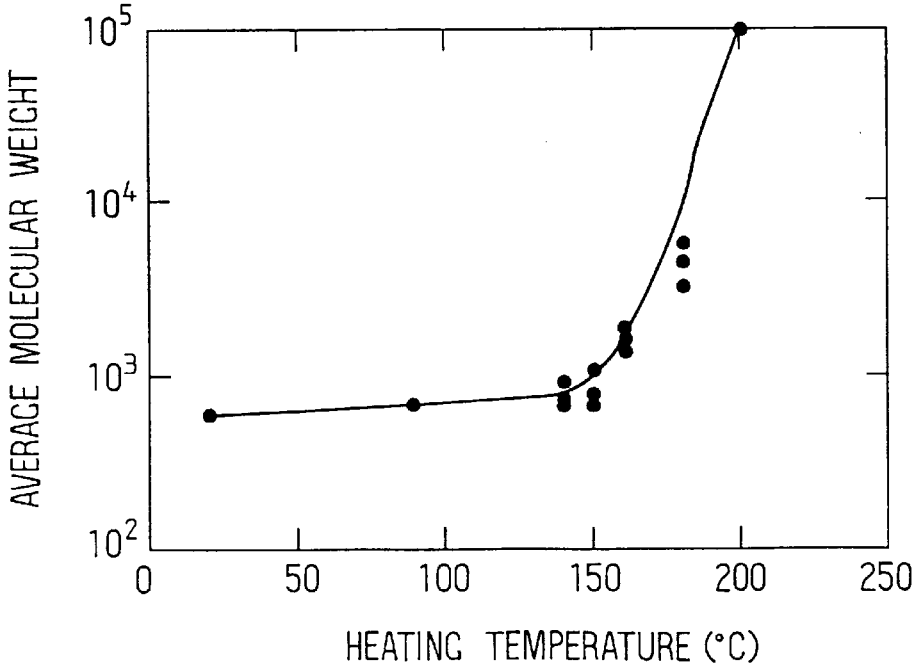
FIG. 6 is a graph illustrating the relation between the heating temperature and the average molecular weight.

The relation between the above-mentioned heating conditions and the average molecular weight is illustrated in FIG. 6. As is understood from this graphic diagram, the lower the heating temperature is, the more suppressed the average molecular weight can be. By setting the heating temperature to fall within a range of from 20° C. to 180° C., it is possible to set the average molecular weight to fall within a range of from approximately 750 to approximately 10000.

Also, the higher the concentration of the dye is, the better the chromaticity of the color filter 7 becomes. Therefore, the dye concentration of 1% or more becomes necessary. However, the higher the dye concentration becomes, the more problems arise, including a decrease in the luminance of the transmission light, an increase in the exposure time length in the photolithographing step, the occurrence of residual development and the like. Therefore, it is preferable that the dye concentration be 50% or less.

Also, as other methods of controlling the average molecular weight, there can be taken up, for example, a method of decreasing the sensitivity to heat in the photolithographing step and a method of adjusting the quantity of, or material constituting, the polymerization initiator or polymerization inhibitor.

(Second Embodiment)

While in this second embodiment the construction thereof is the same as that illustrated in FIG. 1, as the material of the color filter there is used a nega-resist whose polymerization reaction percentage is in a range of from 5% to 70%.

The formation of the color filter 7 in this second embodiment will now be explained.

As the color filter resin there is used a solvent that has been prepared by dispersing a red color pigment (anthraquinone system) into an acrylic resin system nega-resist capable of making a radical polymerization reaction. This solvent is coated by a spinner onto the substrate under the conditions of 500 rpm and 30 sec. Next, prebake is performed within an oven under the conditions of 90° C. and 3 minutes and, through the execution of the photolithographing step, the resulting substrate is formed into a predetermined pattern. In this photolithographing step, the photopolymerization reaction percentage that results from the exposure performed therein was set to be at 49%.

Figure 7:
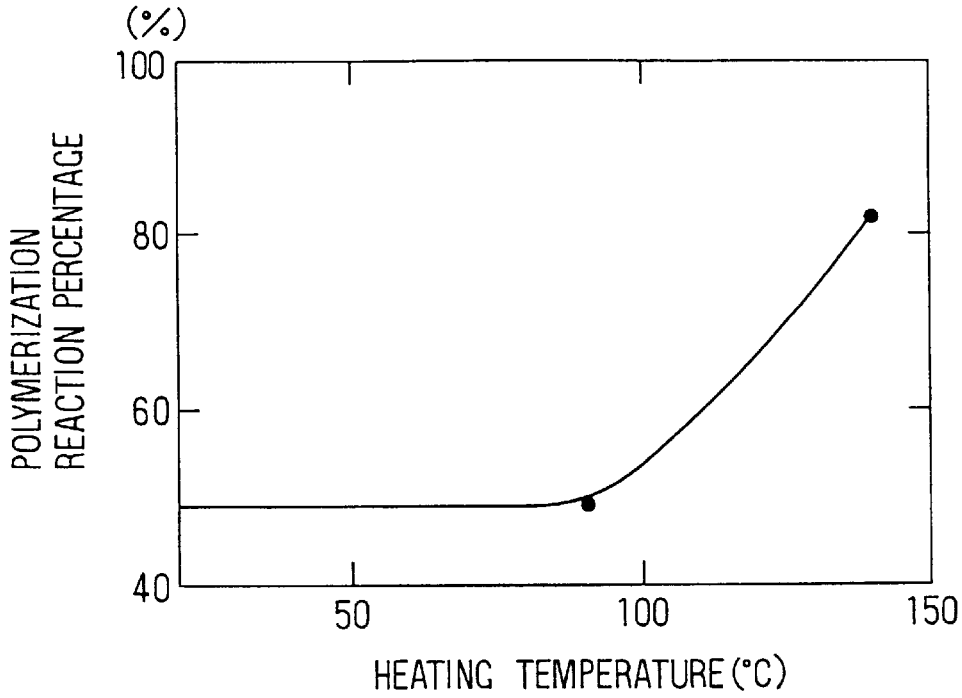
FIG. 7 is a graph illustrating the relation between the heating temperature and the polymerization reaction percentage.

Thereafter, regular bake is performed. In this case, by making the heating conditions the same as the within-oven heating conditions of 90° C. and 3 minutes under which the prebake was performed, further occurrence of the polymerization reaction was suppressed. That is, since the relation between the heating temperature and the polymerization reaction percentage holds true as illustrated in FIG. 7, by setting the heating temperature to be 90° C. the polymerization reaction percentage was maintained to be at 49%. It is to be noted that since in the prebake step the heating was performed at 90° C., the execution of the final regular bake step may be omitted. In this way, there has been formed the color filter 7 whose film thickness is 2 $\mu$m and whose photopolymerization reaction percentage is 49%.

It is to be noted that in this embodiment also in the bonding step of bonding the EL element and the opposing glass substrate 8 to each other the thermo-setting temperature for hardening the bonding agent is set to be at a temperature that is equal to or lower than the heating temperature that was used during the color filter forming step.

Also, as other methods of setting the polymerization reaction percentage of the color filter 7 to fall within a range of from 5% to 70%, there are a method of adjusting the sensitivity to and the radiating quantity of light in the exposure performed in the photolithographing step, a method of changing the conditions of the heating which is performed after the exposure and intended to promote the polymerization reaction, a method of decreasing the sensitivity to heat, a method of adjusting the quantity of, or material constituting, the polymerization initiator or polymerization inhibitor, and the like. In any of these methods, it is possible to weaken the protection effect of the color filter 7 upon the upper transparent electrode 6 and thereby make the dielectric breakdown spot into a self-restoration type.

Also, a chain transfer agent (CTA: activated benzyl vinyl ether) may be added as the polymerization inhibitor to the color filter 7.

(Other Embodiments)

(1) Tin oxide ($SnO_2$), cadmium tin oxide ($CdSnO_4$), zinc oxide (ZnO) or the like as the replacement of ITO can be used as the material of the lower transparent electrode 2 and upper transparent electrode 6.

Figure 8:
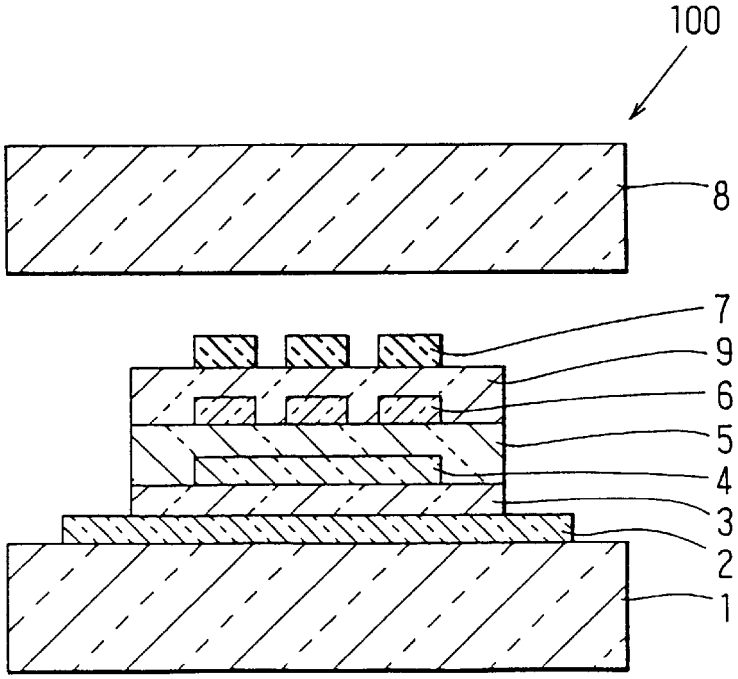
FIG. 8 is a typical view illustrating a longitudinal section of an EL panel according to another embodiment of the present invention.

(2) Although in the above-mentioned embodiments illustration has been made of the structure wherein the color filter 7 is formed directly on the upper electrode 8, as illustrated in FIG. 8 the third insulating layer 9 that is composed of tantalum pentoxide ($Ta_2O_5$) may be formed on the upper transparent electrode 6 and the color filter 7 may be formed thereon.

(3) As the material of the first insulating layer 3, second insulating layer 5 and third insulating layer 9 there may be used in addition to tantalum pentoxide ($Ta_2O_5$) $Al_2O_3$, $Si_3N_4$, $PbTiO_3$, $Y_2O_3$, $HfO_2$, $SiO_2$, SiON, $SrTiO_3$ or the like as a single layer or as a plurality of sub-layers each composed of combined different materials. Further, there may be also used a material such as SOG (Spin On Glass) which has been prepared by coating an organic solvent solution of organic silicon compounds and modifying it into a silicon oxide by desiccating and heating it.

(4) As the dyes that are mixed into the color filter 7 there can be used, for example, nitroso dye, nitro dye, azo dye, stilbene azo dye, keto imine dye, triphenylmethane dye, xanthene dye, acridine dye, quinoline dye, methine, polymethine dye, thiazole dye, indamine, indophenol dye, azine dye, oxazine dye, thiazine dye, sulfur dye, aminoketone, oxyketone dye, anthraquinone dye, indigoid dyes and the like.

(5) As the material of the color filter 7, not only the dyes but also pigments can be used. For example, the color filter 7 may be made of azo pigment, phthalocyanine, dyeing, condensation polycyclic pigment, nitroso, alizarinlake, metal complex azo methine, aniline black, or alkali blue, and may be made, as inorganic pigment, of $Fe_2O_3$, CdS, nCdSe, HgS, $PbCrO_4 \cdot mPbMoO_4 \cdot nPbSO_4$, or the like (provided, however, that m and n are given numerals).

Figure 9:
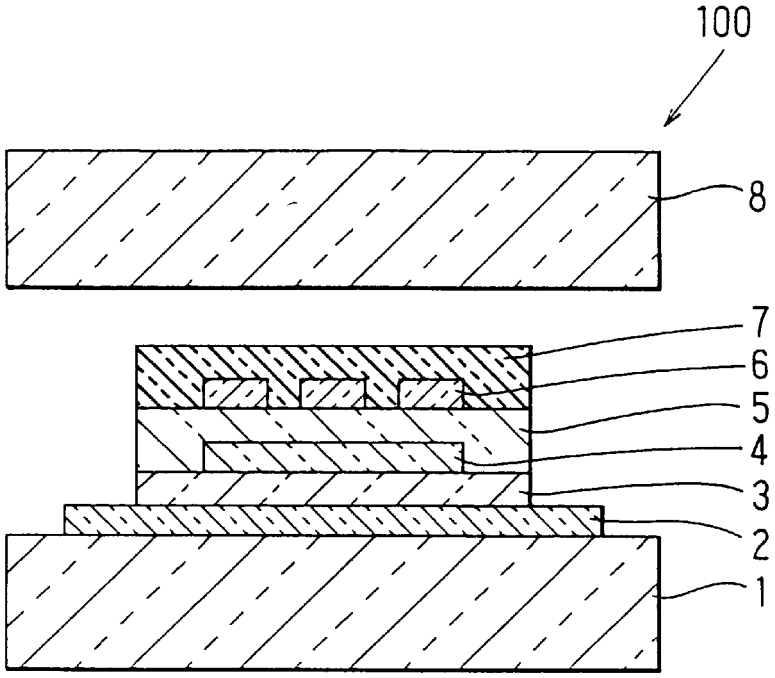
FIG. 9 is a typical view illustrating a longitudinal section of an EL panel according to still another embodiment of the present invention.
Figure 10:
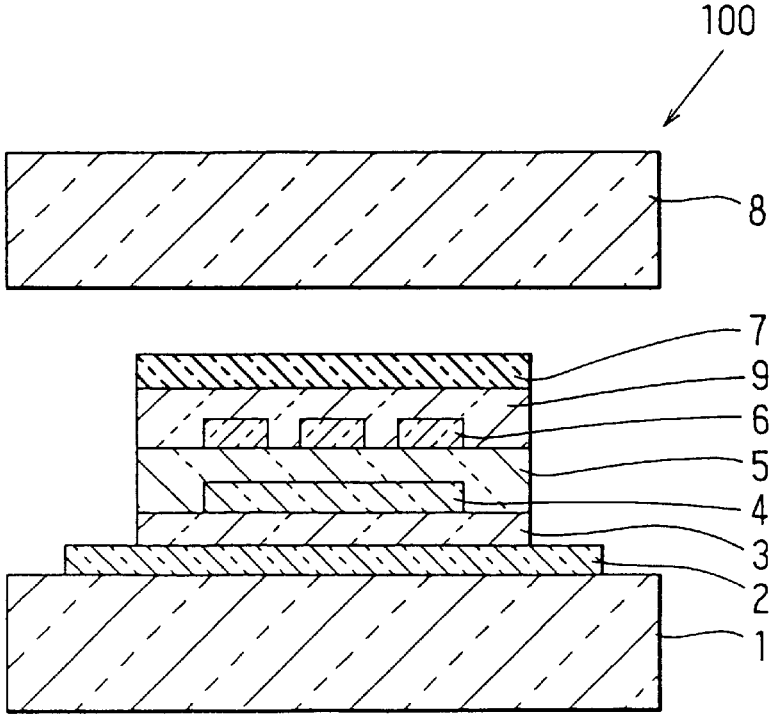
FIG. 10 is a typical view illustrating a longitudinal section of an EL panel according to a further embodiment of the present invention.

(6) Although in the above-mentioned embodiments the color filter 7 has been patterned in correspondence with the luminescent regions, as illustrated in FIGS. 9 and 10 it may be arranged for the color filter to cover the entire EL element inclusive of the non-luminescent regions without patterning it.

Figure 11:
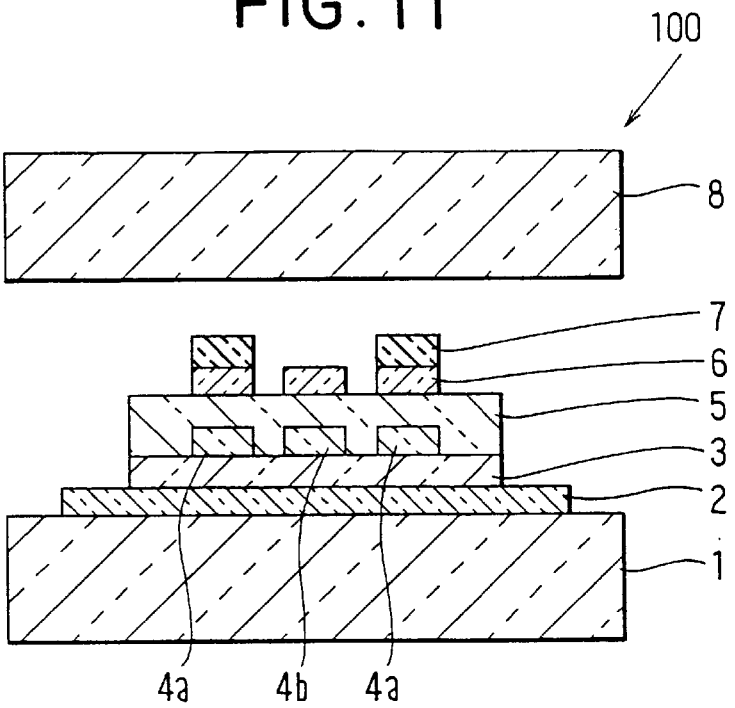
FIG. 11 is a typical view illustrating a longitudinal section of an EL panel according to a yet further embodiment of the present invention.
Figure 12:
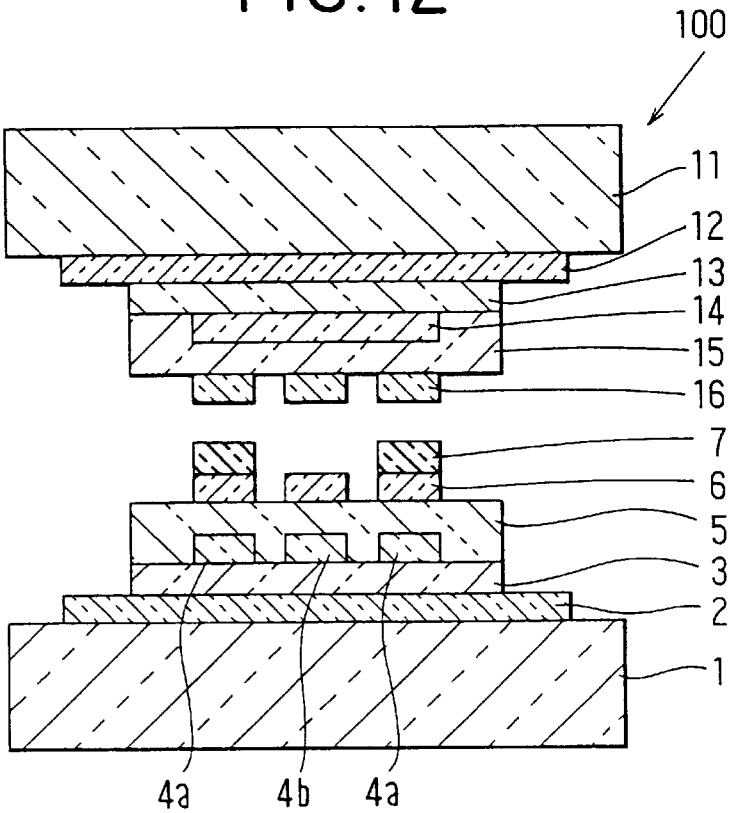
FIG. 12 is a typical view illustrating a longitudinal section of an EL panel according to a yet further embodiment of the present invention.

(7) If as illustrated in FIG. 11 ZnS:Mn luminescent layers 4*a* capable of orange color luminescence and a ZnS:Tb luminescent layer 4*b* capable of green color luminescence are disposed in plane as the luminescent layers and the red color filter 7 is formed in correspondence with the ZnS:Mn luminescent layers 4*a*, multi-color luminescence of red color and green color can be made. If as illustrated in FIG. 12 a structure that is composed of the glass substrate 11, lower transparent electrode 12, first insulating layer 13, blue color luminescent layer 14, second insulating layer 15 and upper transparent electrode 16 is used as the opposing substrate structure, the resulting EL element structure can be made to be a full color EL element.

(8) It is to be noted that the EL element is not limited to that wherein the two insulating layers are provided between the lower and upper transparent electrode and may be that which contains only a single insulating layer alone between the two.

What is claimed is:

1. An EL element comprising an insulating substrate and a lower electrode, insulating layer, luminescent layer and upper transparent electrode laminated directly or indirectly on said insulating substrate, said EL element further comprising a color filter made of organic material and formed on and directly contacting said upper transparent electrode, said organic material having an average molecular weight in a range of from 100 to 50000.

2. An EL element as set forth in claim 1, wherein said average molecular weight of said organic material is equal to or less than 10000.

3. An EL element as set forth in claim 1, wherein said organic material becomes alkali-soluble by radiation of light thereonto so that light-radiated portions are etchable with an alkaline etchant to pattern said color filter.

4. An EL element as set forth in claim 1, wherein said color filter has a thickness of 2 $\mu$m or less.

5. An EL element as set forth in claim 1, wherein said color filter has a thickness that ran between 0.1 $\mu$m and 2 $\mu$m inclusive.

6. A method of manufacturing an EL element, comprising steps of:

preparing an insulating substrate;

laminating a lower electrode, insulating layer, luminescent layer and upper transparent electrode directly or indirectly on said insulating substrate; and forming on, and directly contacting said upper transparent electrode, a color filter which is made of organic material, wherein the step of forming said color filter includes a step of heating said color filter to cause said organic material to have an average molecular weight within a range of from 100 to 50000.

7. A method of manufacturing an EL element as set forth in claim 6, wherein said heating step heats said color filter at a heating temperature in a range of from 20° C. to 180° C.

8. A method of manufacturing an EL element as set forth in claim 6, wherein said organic material has a property of becoming alkali-soluble by radiation of light thereonto.

9. A method of manufacturing an EL element as set forth in claim 6, wherein said color filter has a thickness of 2 $\mu$m or less.

10. A method of manufacturing an EL element as set forth in claim 6, wherein said color filter has a thickness that ranges between 0.1 $\mu$m and 2 $\mu$m inclusive.

11. A method of manufacturing an EL panel, comprising steps of preparing an insulating substrate;

laminating a lower electrode, insulating layer, luminescent layer and upper transparent electrode directly or indirectly on said insulating substrate;

forming on, and directly contacting said upper transparent electrode, a color filter which is made of organic material to form an EL element, the step of forming said color filter including a step of heating said color filter to cause said organic material to have an average molecular weight within a range of from 100 to 50000; and bonding said EL element and an opposing substrate to each other with bonding agent, said bonding agent being hardened by being subject to a thermo-setting temperature which is set to be at a temperature that is equal to or lower than a heating temperature of said step of heating said color filter.

12. An EL element comprising:

an insulating substrate;

a lower electrode formed on said insulating substrate;

a first insulating layer formed on said lower electrode;

a luminescent layer formed on said first insulating layer;

a second insulating layer formed on said luminescent layer;

an upper electrode formed on said second insulating layer; and a color filter formed on and directly contacting said upper electrode, said color filter being made of organic material and having an average molecular weight in a range of from 100 to 50000.

* * * * *